US011827959B2

(12) United States Patent
Holloway

(10) Patent No.: US 11,827,959 B2
(45) Date of Patent: Nov. 28, 2023

(54) METALLIC MATRIX COMPOSITES SYNTHESIZED WITH UNIFORM IN SITU FORMED REINFORCEMENT

(71) Applicant: PARKER LODGE HOLDINGS LLC, Elmhurst, IL (US)

(72) Inventor: Scott Richard Holloway, Calgary (CA)

(73) Assignee: PARKER LODGE HOLDINGS LLC, Elmhurst, IL (US)

( * ) Notice: Subject to any disclaimer, the term of this patent is extended or adjusted under 35 U.S.C. 154(b) by 0 days.

(21) Appl. No.: 18/079,934

(22) Filed: Dec. 13, 2022

(65) Prior Publication Data

US 2023/0104875 A1 Apr. 6, 2023

Related U.S. Application Data

(63) Continuation of application No. 16/098,533, filed as application No. PCT/CA2017/050544 on May 4, 2017, now Pat. No. 11,555,230.

(60) Provisional application No. 62/331,526, filed on May 4, 2016.

(51) Int. Cl.

| | |
|---|---|
| ***C22C 1/05*** | (2023.01) |
| ***C22C 29/06*** | (2006.01) |
| ***C22C 29/12*** | (2006.01) |
| ***C22C 29/14*** | (2006.01) |
| ***C22C 29/16*** | (2006.01) |
| ***C22C 45/08*** | (2006.01) |

(Continued)

(52) U.S. Cl.

CPC ..... *C22C 29/18* (2013.01); *C22C 1/058* (2013.01); *C22C 1/059* (2023.01); *C22C 29/06* (2013.01); *C22C 29/12* (2013.01); *C22C 29/14* (2013.01); *C22C 29/16* (2013.01); *C22C 45/08* (2013.01)

(58) Field of Classification Search

CPC ..... C22C 29/18; C22C 45/08; C22C 1/058; C22C 29/06; C22C 29/12; C22C 29/14; C22C 29/16

See application file for complete search history.

(56) References Cited

FOREIGN PATENT DOCUMENTS

| | | |
|---|---|---|
| CN | 1775976 A | 5/2006 |
| CN | 10281950 A | 12/2012 |
| CN | 102151937 B | 10/2013 |

(Continued)

OTHER PUBLICATIONS

Levashov EA et al: "Effect of Nanocrystalline Powders on the Structure and Properties of Dispersion-Hardened Alloy TiC—40% KhN70Yu", Metallurgist, Kluwer Academic Publishers-Plenum Publishers, NE, vol. 47, No. 3-4, Mar. 1, 2003 (Mar. 1, 2003), pp. 133-139 (Year: 2003).*

(Continued)

*Primary Examiner* — Rebecca Janssen

(57) ABSTRACT

Metallic matrix composites are synthesized by mixing a first reactant, a second reactant and a nucleator compound to obtain a reaction mixture, and heating the reaction mixture to an auto-activation temperature to initiate a self-propagating high-temperature synthesis reaction between the first and second reactants. The metallic matrix composite can include a metallic matrix and an in situ formed reinforcement. The reinforcement can be formed of discrete particles substantially uniformly dispersed within the metallic matrix. Each of the particles can have a reinforcement constituent disposed about a core formed of the nucleator compound.

17 Claims, 7 Drawing Sheets

(51) Int. Cl.
*C22C 29/18* (2006.01)
*C22C 1/059* (2023.01)

(56) References Cited

FOREIGN PATENT DOCUMENTS

| | | | |
|---|---|---|---|
| WO | 2012108980 | A1 | 8/2012 |
| WO | 2017190243 | A1 | 11/2017 |
| WO | 2017190245 | A1 | 11/2017 |
| WO | 2017190246 | A1 | 11/2017 |
| WO | 2017190247 | A1 | 11/2017 |

OTHER PUBLICATIONS

Lima et al. Metal Matrix Composites from Self-Propagating Synthesis and Hot Pressing Microscopy and Analysis, Sep. 2001, pp. 29-31 (Year: 2001).*
International Search Report dated Aug. 30, 2017, in respect of International Application No. PCT/2017/050544.
International Preliminary Report on Patentability dated Nov. 6, 2018, in respect of International Application No. PCT/2017/050544.
Jiang et al., "Fabrication of steel matrix composites locally reinforced with in situ TiB2—TiC particulates using self-propagating high temperature synthesis reaction of Al—Ti—B4C system during casting", Composites: Part A 2006, 37, 133-138.
Jiang et al., "In situ TiC-reinforced steel composite fabricated via self-propagating high-temperature synthesis of Ni—Ti—C system", Materials Letters 59, 2005, 2043-2047.
Lima et al., "Metal Matrix Composites from Self-Propagating Synthesis and Hot Pressing", Microscopy and Analysis, Sep. 2001, 29-31, (Year: 2001).
Mishra et al., "Fabrication of A12O3—ZrB2 in situ composite by SHS dynamic compaction: A novel approach", Composites Science and Technology 2007, 67, 2447-2453.
Mishra et al., "Self Propagating High temperatures Synthesis (SHS) of Advanced High Temperature Materials", Proceedings of the Indo-Malaysian Joint Workshop 2002 (WAM-2002), 107, 14 pages.
Mishra et al., "Fabrication of in-situ Ti—Si—C fine grained composite by the self propagating high temperature synthesis (SHS) process", Int. Journal of Refractory Metals and Hard Materials 2011, 29, 209-213.
Evashov et al., "Effect of Nanocrystalline Powders on the Structure and Properties of Dispersion-Hardened Alloy TiC—40% KhN70Yu", Metallurgist, Kluwer Academic Publishers-Plenum Publishers, Ne, vol. 47, Nos. 3-4, Mar. 1, 2003, (Mar. 1, 2003), pp. 133-139 (Year; 2003).
European Examination Report dated Apr. 20, 2023, for the Europe Patent Application No. 17792338.0 filed on May 4, 2017.
Evashov, E.A. et al., "In the Russian Academy of Natural Sciences: Effect of Nanocrystalline Powders on the Structure and Properties of Dispersion-Hardened Alloy TiC—40% KhN70Yu", Metallurgist, vol. 47, Nos. 3-4, 2003, pp. 133-139.
Lima, Margarida et al., "Metal Matrix composites from Self-Propagating Synthesis and Hot Pressing", Matrix Composites, Microscopy and Analysis, Sep. 2001, pp. 29-31.

* cited by examiner

METALLIC MATRIX COMPOSITES SYNTHESIZED WITH UNIFORM IN SITU FORMED REINFORCEMENT

CROSS-REFERENCE TO RELATED APPLICATIONS

This is a continuation application of U.S. patent application Ser. No. 16/098,533 filed Nov. 2, 2018, which is a national stage application of International Application No. PCT/CA2017/050544 filed May 5, 2017, which claims priority to U.S. Patent Application No. 62/331,526 filed May 4, 2016, and the entire contents of each are hereby incorporated herein by reference.

FIELD

The present disclosure relates generally to self-propagating high-temperature synthesis reactions, and notably to methods of making metallic matrix composites using self-propagating high-temperature synthesis reactions.

INTRODUCTION

The following paragraphs are not an admission that anything discussed in them is prior art or part of the knowledge of persons skilled in the art.

A self-propagating high-temperature synthesis reaction (or "SHS" reaction) can be said to be an exothermic chemical reaction having a rate of reaction and subsequent rate of heating which is sufficient to cause the chemical reaction to self-propagate. Techniques to perform SHS reactions can be used to make metallic matrix composite compounds. The resultant reaction products frequently exhibit unique material characteristics deemed useful for science and engineering applications. Thus, methods and techniques for the performance of SHS reactions for metallic matrix composite compounds are deemed highly desirable.

In its simplest form, an SHS reaction can be said to occur according to the following chemical formula:

$$A+B \rightarrow AB-\Delta H,$$

where "A" and "B" are elements which combine to form chemical compound "AB", and the term ΔH is the heat of reaction, which can be calculated as follows:

$$\Delta H=\Sigma\Delta_f H_{PRODUCTS}-\Sigma\Delta_f H_{REACTANTS},$$

where $\Delta_f H$ is the enthalpy of formation. For the chemical formula above, the value of ΔH can be calculated as:

$$\Delta H=\Delta_f H_{AB}-\Delta_f H_A-\Delta_f H_B,$$

and because the enthalpy of formation of elements is defined to be zero, this equation can be reduced to:

$$\Delta H=\Delta_f H_{AB}.$$

For exothermic reactions the value of ΔH is defined as less than zero, and is equal to the amount of heat energy per mole of reactant released as a result of the reaction.

In order to understand whether or not a driving force exists for the reaction, it is generally necessary to evaluate the change in Gibbs free energy, which can be said to related to the heat of the reaction, temperature and change in entropy by the equation:

$$\Delta G=\Delta H-T\Delta S.$$

In order for the driving force to exist, the value of ΔG must be less than zero, and in such cases the reaction can be said to be "spontaneous". The change in Gibbs free energy for the reaction can be calculated as:

$$\Delta G=\Sigma\Delta_f G_{PRODUCTS}-\Sigma\Delta_f G_{REACTANTS},$$

where $\Delta_f G$ is the Gibbs free energy of formation for the compounds in the reaction. For the reaction above, the change in Gibbs free energy can be calculated as:

$$\Delta_f G=\Delta_f G_{AB},$$

where "$\Delta_f G_{AB}$" is the Gibbs free energy of formation for the chemical compound "AB".

Chemical reactions are the result of collisions between the constituent atoms of the reactants, and therefore it is generally assumed true that a certain amount of energy must be put into the system in order to cause a sufficient number of collisions with sufficient energy to break the bonds between the reactant atoms. This is true even if the ΔG is less than zero, and the reaction is considered to be spontaneous. The amount of energy necessary to cause the reaction to proceed is referred to as the activation energy ($E_a$), and the relationship between $E_a$, ΔH and the progression of the reaction is illustrated in FIG. 1.

The reaction rate (v), which is commonly thought of in terms of the number of moles of reactant consumed per unit time can be expressed as follows:

$$v=-\frac{d[A]}{dt}-\frac{d[B1}{dt},$$

where the term "[A]" and "[B]" represent the concentration of the reactants A and B. For the simple reaction above, which is second order overall and first order in each reactant, the reaction rate can be calculated as:

$$v=k[A][B].$$

The term "k" is known as the rate constant, which also has units of moles per unit time. The Arrhenius equation, which was originally derived empirically, quantifies the rate constant for ideal gas reactions as a function of the activation energy ($E_a$) and temperature (T) and can be expressed as follows:

$$k=F\cdot e^{-E_a/(RT)},$$

where the pre-exponential factor "F" is the atomic collision frequency, and "R" is the universal gas constant. The exponential term is the probability that the given collision will in fact result in a reaction.

Similarly, transition state theory provides the means to calculate the rate constant (k) as a function of temperature and the Gibbs energy of activation ($\Delta G^{\ddagger}$) using the Eyring equation, which can be expressed as follows:

$$k=\frac{k_B T}{h}\cdot e^{\Delta G^{*}/(RT)},$$

where $K_B$ is Boltzmann's constant and "h" is Planck's constant. The Gibbs energy of activation is the standard Gibbs energy difference between the transition state of a reaction and the ground state of the reactants, and is therefore analogous to the activation energy (FIG. 2). When evaluating the SHS reactions and relating thermodynamics to reaction kinetics, it is often convenient to do so using transition state theory and the Eyring equation.

In order to trigger a self-propagating exothermic reaction, it is generally necessary to apply heat energy in excess of the activation energy to a sufficient portion of the reactant material, such that the heat of the resulting reaction in turn provides sufficient energy to exceed the activation energy of neighboring unreacted material. As a result, the neighboring material can then react, and this chain reaction can continue to propagate until all of the reactant material is consumed. Because the heat of reaction is necessary to maintain SHS, consideration must be given to the heat lost to the surrounding environment. In order to minimize heat loss, all reactant material can be heated uniformly until multiple points of activation occur simultaneously and then quickly propagate throughout. This method of SHS is commonly referred to as "thermal explosion mode".

In summary, SHS reactions can be characterized as exothermic (i.e. having a $\Delta H<0$) and spontaneous (i.e. having a $\Delta G<0$).

One class of materials that can be produced using SHS is "in situ" metallic matrix composites. These are composites comprising a reinforcement phase, wherein the reinforcement phase directly participates in the SHS reaction. Two primary reactions can be distinguished. The first reaction can be described in its basic form as:

$$A+BY \rightarrow B+AY-\Delta H,$$

where "A" and "B" are metallic elements. Y is a non-metallic element, including, but not limited to boron, carbon, nitrogen or oxygen. "BY" and "AY" are chemical compounds containing at least one metallic element and at least one non-metallic element and "AY" is the in situ formed reinforcement phase. This reaction is characterized by the element "B" appearing in its pure elemental form, which does not react with chemical compound "A". The resulting heat of the reaction ($\Delta H$) can be given by:

$$\Delta H=\Delta_f H_{AY}-\Delta_f H_{BY},$$

and the change in Gibbs free energy ($\Delta G$) can be given by:

$$\Delta G=\Delta_f G_{AY}-\Delta_f G_{BY}.$$

This type of reaction can further be generalized to include additional reactant compounds, described in general as:

$$A+BY+\{CY\ldots\}\rightarrow B\{C\ldots\}+AY-\Delta H,$$

where the reactant term $\{CY\ldots\}$ represents any number of additional compounds containing at least one metallic element and at least one non-metallic element, and the product term $B\{CY\ldots\}$ represents any possible combination of metallic phases, such as "BC", "B+C", etc.

For this generalized form the heat reaction van be given by:

$$\Delta H=\Delta_f H_{B\{C\ldots\}}+\Delta_f H_{AY}-\Delta_f H_{BY}-\Delta_f H_{\{CY\ldots\}},$$

with the change in Gibbs free energy ($\Delta G$) given by:

$$\Delta G=\Delta_f G_{B\{C\ldots\}}+\Delta_f G_{AY}-\Delta_f G_{BY}-\Delta_f G_{\{CY\ldots\}}.$$

The second reaction of the two types of primary reactions is characterized by the element "B" forming a chemical compound "AB" with reactant "A", which can be described in its basic form as:

$$A+BY \rightarrow AB+AY-\Delta H$$

and the resulting heat ($\Delta H$) of the reaction can be given by:

$$\Delta H=\Delta_f H_{AB}+\Delta_f H_{AY}-\Delta_f H_{BY},$$

and the change in Gibbs free energy ($\Delta G$) can be given by:

$$\Delta G=\Delta_f G_{AB}+\Delta_f G_{AY}-\Delta_f G_{BY}.$$

Similarly, this type of reaction can be further generalized to include additional reactant compounds, and can be described in general form as follows:

$$A+BY+\{CY\ldots\}\rightarrow AB\{C\ldots\}+AY-\Delta H,$$

and the resulting heat of reaction ($\Delta H$) can be given by:

$$\Delta H=\Delta_f H_{AB\{C\ldots\}}+\Delta_f H_{AY}-\Delta_f H_{BY}-\Delta_f H_{\{CY\ldots\}},$$

and the change in Gibbs free energy ($\Delta G$) can be given by:

$$\Delta G=\Delta_f G_{AB\{C\ldots\}}+\Delta_f G_{AY}-\Delta_f G_{BY}-\Delta_f G_{\{CY\ldots\}},$$

where the product term $AB\{C\ldots\}$ represents any possible combination of metallic phases, such as "ABC", AB+AC", AB+BC", "AC+BC", "A+B+C", etc.

In terms of notation, the two primary types of reactions can be written in a combined basic form as:

$$A+BY \rightarrow (A)B+AY-\Delta H,$$

and the resulting heat of reaction ($\Delta H$) can be given by:

$$\Delta H=\Delta H_{(A)B}+\Delta_f H_{AY}-\Delta_f H_{BY},$$

and the change in Gibbs free energy ($\Delta G$) can be given by:

$$\Delta G=\Delta_f G_{(A)B}+\Delta_f G_{AY}-\Delta_f G_{BY},$$

where the term "(A)B" means the element "A" may or may not react to form a chemical compound with element "B", and this notation can further be generalized to include additional reactant compounds, described in general form as:

$$A+BY+\{CY\}\rightarrow (A)B\{C\ldots\}+AY-\Delta H,$$

and the resulting heat of reaction ($\Delta H$) can be given by:

$$\Delta H=\Delta_f H_{(A)B\{CY\ldots\}}+\Delta_f H_{AY}-\Delta_f H_{BY}-\Delta_f H_{\{CY\ldots\}},$$

and the change in Gibbs free energy ($\Delta G$) can given by:

$$\Delta G=\Delta_f G_{(A)B\{CY\ldots\}}+\Delta_f G_{AY}-\Delta_f G_{BY}-\Delta_f G_{\{CY\ldots\}}.$$

Additionally, it is also possible to include in the in situ metallic matrix composite material elements or compounds ("X") which do not directly participate in the exothermic reaction, but which are integral to the reaction product. The addition of "X" can be described in its basic form as:

$$A+BY+X \rightarrow (A)B+AY+X-\Delta H,$$

and the resulting heat of reaction ($\Delta H$) can be given by:

$$\Delta H=\Delta_f H_{(A)B}+\Delta_f H_{AY}-\Delta_f H_{BY},$$

and the change in Gibbs free energy ($\Delta G$) can be given by:

$$\Delta G=\Delta_f G_{(A)B}+\Delta_f G_{AY}-\Delta_f G_{BY}.$$

It is noted that the compound "X" is not included in the calculation of the heat reaction or the Gibbs free energy because it does not participate directly in the chemical reaction.

The formula can be further generalized to include additional reactant compounds "$\{CY\ldots\}$" or additional non-reactive elements or compounds "$\{X\}$", described in general form as:

$$A+BY+\{CY\ldots\}+\{X\ldots\}\rightarrow (A)B\{C\ldots\}+AY+\{X\ldots\}-\Delta H,$$

and the resulting heat of reaction ($\Delta H$) can be given by:

$$\Delta H=\Delta_f H_{(A)B\{CY\ldots\}}+\Delta_f H_{AY}-\Delta_f H_{BY}-\Delta_f H_{\{CY\ldots\}},$$

and the change in Gibbs free energy ($\Delta G$) can be given by:

$$\Delta G=\Delta_f G_{(A)B\{CY\ldots\}}+\Delta_f G_{AY}-\Delta_f G_{BY}-\Delta_f G_{\{CY\ldots\}}.$$

While the compounds "$\{X\ldots\}$" are not considered with regard to whether or not the reaction is exothermic or spontaneous, it can be important to consider other thermal and mechanical effects of such additives. For example, any compound X will absorb heat from the reaction as a function of the compounds thermal conductivity and heat capacity ($C_p$), and in that sense it is analogous to heat lost to the environment. Such absorbed heat is temporarily unavailable with regard to propagating the reaction, although it is ultimately transferred back to the reaction product and ultimately out to the environment. In this sense, the thermal effect of such additives is transient heat transfer behavior relative to the reaction, or in other words a time delay in terms of making the heat of the reaction available for self-propagation.

The in situ formation of reinforcement compound "AY" during an SHS process yielding a metallic matrix composite material can be said to be the result of a nucleation and growth process. Generally, in an SHS process, individual crystals "AY" can randomly nucleate within the reaction mixture and grow, for example, to sizes larger than 10 μm, which can agglomerate or interconnect, as shown in FIGS. 3A and 3B. The resultant composite material comprises two independent materials each with its own material properties.

One frequently occurring limitation in in situ formed metallic matrix composite materials is that due to the agglomerated and interconnected nature of the reinforcement compound, material properties exhibited by the composite can be dominantly imparted by the reinforcement compound. It is instead however frequently desirable that the material properties imparted by metallic matrix compound are more dominant.

Another shortcoming in known in situ formed metallic matrix composite materials is that the agglomerated and interconnected reinforcement phase is generally non-uniformly distributed throughout the composite. Local variations in the reinforcement phase structure can inherently result in a non-uniform distribution of material properties, such as mechanical properties. Thus, the material toughness and strength of metallic matrix composites is frequently suboptimal, limiting the use of composites in science and engineering applications.

A further limitation in in situ formed metallic matrix composite materials, and methods known to make these materials, is that it is common to observe substantial variations in microstructure throughout a composite material, as a result of the dependency of nucleation and crystal growth on temperature which typically varies within a reaction mixture since temperature gradients are formed to transfer heat. This translates in a non-uniform distribution of material properties within the metallic matrix, which as noted can make it challenging to use the materials.

Another significant shortcoming in in situ formed metallic matrix composites materials and known methods of making these composites, is that it is common to observe residual stress caused by a mismatch in thermal expansion between the metallic matrix material and the reinforcement material. This can result in substantial variations in microstructure. When producing the metallic matrix composite, the material can suffer fracturing and catastrophic failure, while cooling down from the high synthesis temperature, often within minutes of the SHS reaction. This can make the development of commercial scale production processes for manufactured articles constituted of the metallic matrix composites challenging, as the processes can suffer from unacceptably high numbers of product rejects.

Thus, there are numerous shortcomings associated with known SHS processes for the formation of metallic matrix composites. There remains a need for techniques for performing such processes, as well as a need for improved metallic matrix composites.

SUMMARY

The following paragraphs are intended to introduce the reader to the more detailed description that follows and not to define or limit the claimed subject matter.

The present disclosure relates to metallic matrix composites and methods of making the same, and further relates to SHS reactions.

In an aspect of the present disclosure, a method of synthesizing a metallic matrix composite is provided. The method can comprise: providing a first reactant that is a metallic element or a metallic compound; providing a second reactant that is a metallic element or a metallic compound; providing an inert nucleator compound; mixing the first reactant, the second reactant and the nucleator compound to obtain a reaction mixture; and heating the reaction mixture to an auto-activation temperature to initiate a self-propagating high-temperature synthesis reaction between the first and second reactants and thereby produce the metallic matrix composite, the metallic matrix composite comprising a metallic matrix and an in situ formed reinforcement, the reinforcement comprising discrete particles substantially uniformly dispersed within the metallic matrix, each of the particles comprising a reinforcement constituent disposed about a core formed of the nucleator compound.

The discrete particles can have a mean particle size of less than about 3 m. The nucleator compound can be provided substantially in the form of a particulate having a mean average particle size of no more than about 1 μm.

The first reactant can be a metallic element, and the nucleator compound can be a metallic element bonded to a non-metallic element. $\Delta_f H$ of a metallic compound consisting of the metallic element of the nucleator compound bonded to the metallic element of the first reactant minus $\Delta_f H$ of the nucleator compound, can be larger than $\Delta_f H$ of the metallic matrix minus $\Delta_f H$ of the reinforcement. $\Delta_f G$ of a metallic compound consisting of the metallic element of the nucleator compound bonded to the metallic element of the first reactant minus $\Delta_f G$ of the nucleator compound, can be larger than $\Delta_f G$ of the metallic matrix minus $\Delta_f G$ of the reinforcement.

At least one of the first and second reactants can be a metallic compound formed of a metallic element bonded to a non-metallic element selected from the group consisting of B, N, O and Si, and the nucleator compound can consist substantially of the non-metallic element.

The nucleator compound can comprise a metallic element. The nucleator compound can comprise a divalent metallic element. The nucleator compound can consist substantially of a divalent metallic element bonded to a non-metallic element. The non-metallic element can be selected from the group consisting of B, N, O and Si. The nucleator compound can comprise Zr. The nucleator compound can consist substantially of a compound selected from the group consisting of $B_4C$, $ZrB_2$, $ZrO_2$, and $ZrO_2$-3Y.

At least one of the first and second reactants can be a metallic compound consisting of two or more bonded metallic elements. At least one of the first and second reactants can be a metallic compound consisting of at least one metallic element bonded to at least one non-metallic element. At least one of the first and second reactants can be a metallic element selected from the group consisting of Ag, Al, Fe, Mg, Ni, and Ti. At least one of the first and second reactants can be a metallic compound consisting of a metallic element selected from the group consisting of Ag, Al, Fe, Mg, Ni, and Ti bonded to another metallic element. At least one of the first and second reactants can be a metallic compound consisting of a metallic element selected from the group consisting of Ag, Al, Fe, Mg, Ni, and Ti bonded to a non-metallic element. At least one of the first and second reactants can be a metallic compound selected from the group consisting of a metal boride, a metal carbide, a metal nitride, a metal oxide, and a metal silicide.

The first reactant can be Al, the second reactant can be $TiO_2$, the metallic matrix can consist substantially of TiAl, and the in situ formed reinforcement can consist substantially of $Al_2O_3$. The nucleator compound can consist substantially of a compound selected from the group consisting of $ZrO_2$, $ZrO_2$—Y, and $ZrO_2$-3Y.

The self-propagating high-temperature synthesis reaction can be characterized by a $\Delta H<0$ and a $\Delta G<0$.

An article of manufacture can comprise a metallic matrix composite synthesized by the methods herein. The article of manufacture can be selected from the group consisting of an automotive part, an aeronautical part, an armory part.

In an aspect of the present disclosure, a metallic matrix composite can comprise: a metallic matrix; and an in situ formed reinforcement, wherein the reinforcement comprises discrete particles substantially uniformly dispersed within the metallic matrix, and wherein each of the particles comprises a reinforcement constituent disposed about a core formed of an inert nucleator compound.

The discrete particles can have a mean particle size of less than about 3 m. The nucleator compound can be substantially in the form of a particulate having a mean average particle size of no more than about 1 μm.

The first reactant can be a metallic element, and the nucleator compound can be a metallic element bonded to a non-metallic element. $\Delta_f H$ of a metallic compound consisting of the metallic element of the nucleator compound bonded to the metallic element of the first reactant minus $\Delta_f H$ of the nucleator compound, can be larger than $\Delta_f H$ of the metallic matrix minus $\Delta_f H$ of the reinforcement. $\Delta_f G$ of a metallic compound consisting of the metallic element of the nucleator compound bonded to the metallic element of the first reactant minus $\Delta_f G$ of the nucleator compound, can be larger than $\Delta_f G$ of the metallic matrix minus $\Delta_f G$ of the reinforcement.

At least one of the first and second reactants can be a metallic compound formed of a metallic element bonded to a non-metallic element selected from the group consisting of B, N, O and Si, and the nucleator compound can consist substantially of the non-metallic element.

The nucleator compound can comprise a metallic element. The nucleator compound can comprise a divalent metallic element. The nucleator compound can consist substantially of a divalent metallic element bonded to a non-metallic element. The non-metallic element can be selected from the group consisting of B, N, O and Si. The nucleator compound can comprise Zr. The nucleator compound can consist substantially of a compound selected from the group consisting of $B_4C$, $ZrB_2$, $ZrO_2$, and $ZrO_2$-3Y.

At least one of the first and second reactants can be a metallic compound consisting of two or more bonded metallic elements. At least one of the first and second reactants can be a metallic compound consisting of at least one metallic element bonded to at least one non-metallic element. At least one of the first and second reactants can be a metallic element selected from the group consisting of Ag, Al, Fe, Mg, Ni, and Ti. At least one of the first and second reactants can be a metallic compound consisting of a metallic element selected from the group consisting of Ag, Al, Fe, Mg, Ni, and Ti bonded to another metallic element. At least one of the first and second reactants can be a metallic compound consisting of a metallic element selected from the group consisting of Ag, Al, Fe, Mg, Ni, and Ti bonded to a non-metallic element. At least one of the first and second reactants can be a metallic compound selected from the group consisting of a metal boride, a metal carbide, a metal nitride, a metal oxide, and a metal silicide.

The first reactant can be Al, the second reactant can be $TiO_2$, the metallic matrix can consist substantially of TiAl, and the in situ formed reinforcement can consist substantially of $Al_2O_3$. The nucleator compound can consist substantially of a compound selected from the group consisting of $ZrO_2$, $ZrO_2$—Y, and $ZrO_2$-3Y.

The metallic matrix composite can be used in an article of manufacture. The article of manufacture can be selected from the group consisting of an automotive part, an aeronautical part, an armory part.

Other features and advantages of the present disclosure will become apparent from the following detailed description. It should be understood, however, that the detailed description, while indicating preferred embodiments of the disclosure, are given by way of illustration only, since various changes and modifications within the spirit and scope of the disclosure will become apparent to those of skill in the art from the detailed description.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Figure 1:
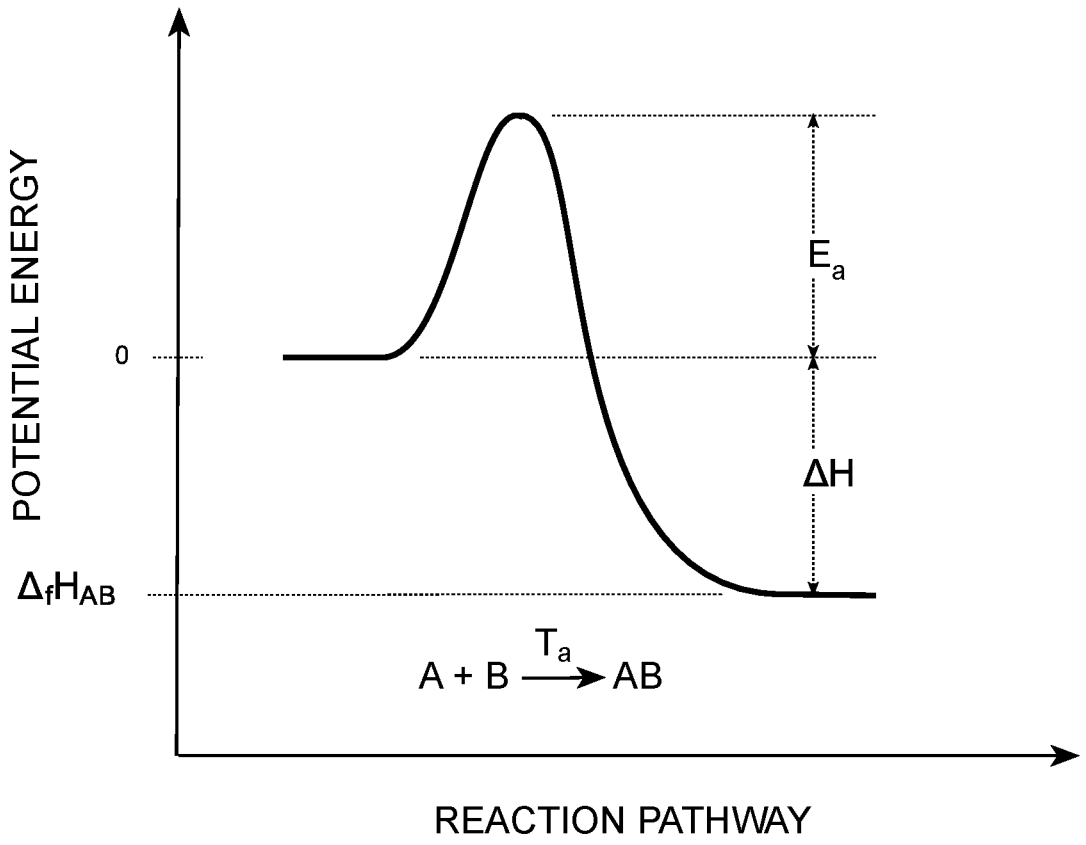
FIG. 1 is a graph illustrating, in general, the potential energy of a chemical reaction to form compound AB from reactants A and B as a function of the reaction pathway, wherein the reaction has a negative ΔH, i.e. the reaction is exothermic and releases heat equal to ΔH. The amount of energy necessary to cause the reaction to proceed is denoted as the activation energy ($E_a$), and the relationship between $E_a$, and ΔH is shown. The $\Delta H_f AB$, representing the enthalpy of formation for the compound AB is also shown.
Figure 2:
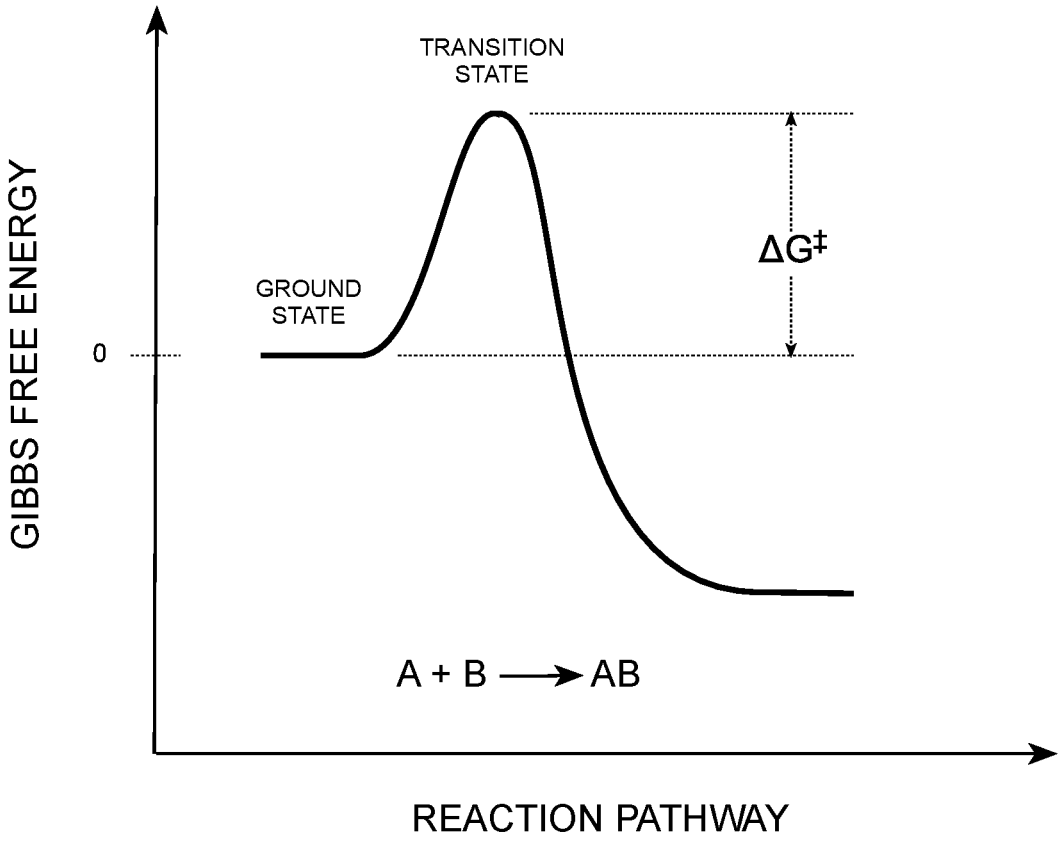
FIG. 2 is a graph illustrating, in general, the Gibbs free energy (ΔG) of a chemical reaction to form compound AB from reactants A and B as a function of the reaction pathway, wherein the reaction has a negative ΔG, i.e. the reaction is spontaneous. The amount of energy necessary to cause the reaction to proceed from its ground state to its transition state is denoted as Gibbs energy of activation ($\Delta G^{\ddagger}$).
Figure 3A:
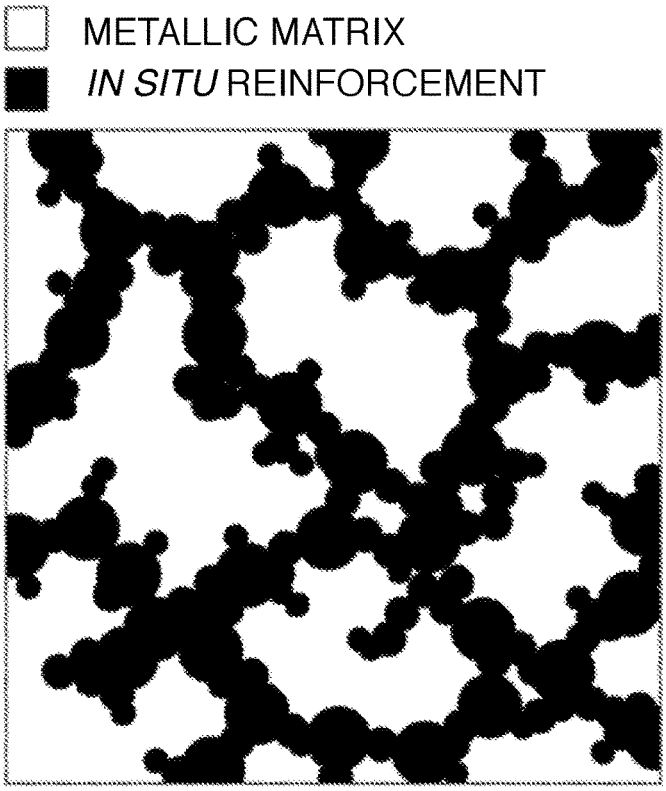
FIGS. 3A and 3B are sketches of a cross-sectional microscopic view of metallic matrix composite material made according to methods known to the prior art, shown at a higher magnification (FIG. 3A) and a lower magnification (FIG. 3B).
Figure 3B:
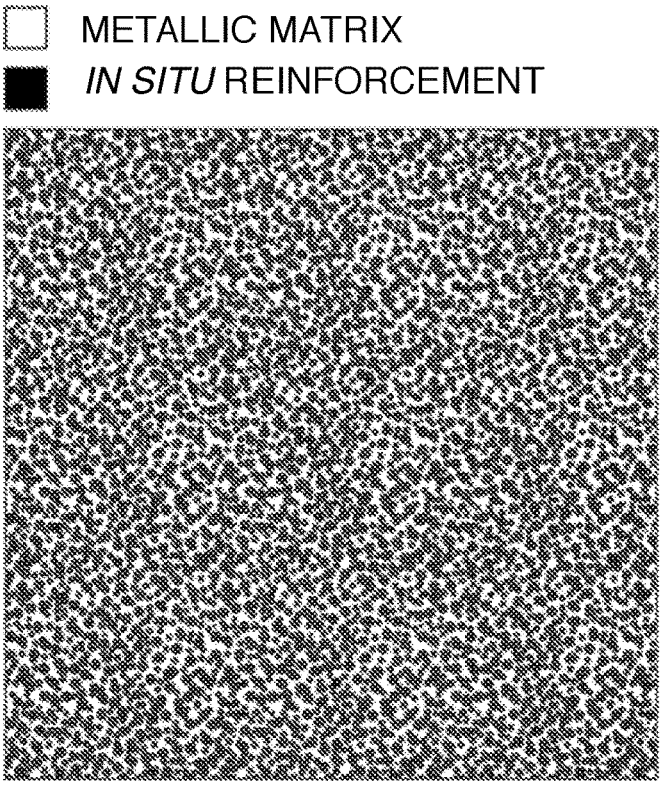

Various apparatuses, methods or compositions will be described below to provide an example of an embodiment of each claimed invention. No embodiment described below limits any claimed invention and any claimed invention may cover apparatuses, methods and compositions that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

Terms and Definitions

As used herein and in the claims, the singular forms, such "a", "an" and "the" include the plural reference and vice versa unless the context clearly indicates otherwise. Throughout this specification, unless otherwise indicated, "comprise", "comprises" and "comprising" are used inclusively rather than exclusively, so that a stated integer or group of integers may include one or more other non-stated integers or groups of integers. The term "or" is inclusive unless modified, for example, by "either".

When ranges are used herein for physical properties, such as molecular weight, or chemical properties, such as chemical formulae, all combinations and sub-combinations of ranges and specific embodiments therein are intended to be included. Other than in the operating examples, or where otherwise indicated, all numbers expressing quantities of ingredients or reaction conditions used herein should be understood as modified in all instances by the term "about". The term "about" when referring to a number or a numerical range means that the number or numerical range referred to is an approximation within experimental variability (or within statistical experimental error), and thus the number or numerical range may vary between 1% and 15% of the stated number or numerical range, as will be readily recognized by context. Furthermore, any range of values described herein is intended to specifically include any intermediate value or sub-range within the given range, and all such intermediate values and sub-ranges are individually and specifically disclosed (e.g., 1 to 5 includes 1, 1.5, 2, 2.75, 3, 3.90, 4, and 5). Similarly, other terms of degree such as "substantially" and "approximately" as used herein mean a reasonable amount of deviation of the modified term such that the end result is not significantly changed. These terms of degree should be construed as including a deviation of the modified term if this deviation would not negate the meaning of the term it modifies.

Unless otherwise defined, scientific and technical terms used in connection with the formulations described herein shall have the meanings that are commonly understood by those of ordinary skill in the art. The terminology used herein is for the purpose of describing particular embodiments only, and is not intended to limit the scope of the present invention, which is defined solely by the claims.

The symbol "ΔG", as used herein, refers to the Gibbs free energy of a chemical reaction, which, for a given chemical reaction, can be expressed in Joules and be positive or negative (or 0) and can be calculated, experimentally determined, or identified in a standard chemical reference work, such as *Thermochemical Data of Pure Substances* by Ihsan Barin, (1995) 3$^{rd}$ edition, Wiley-VCH Verlag, Weinheim, Germany.

The symbol "$\Delta G^{\ddagger}$", as used herein, refers to the Gibbs free energy of activation of a chemical reaction, which, for a given chemical reaction, can be expressed in Joules and represents the amount of energy required to cause a chemical reaction to proceed from its ground state to its transition state, and can be calculated, experimentally determined, or identified in a standard chemical reference work, such as *Thermochemical Data of Pure Substances* by Ihsan Barin, (1995) 3$^{rd}$ edition, Wiley-VCH Verlag, Weinheim, Germany.

The symbol "$\Delta_f G$", as used herein, refers to the Gibbs free energy for the formation of a chemical compound comprising at least two bonded chemical elements, which for a given chemical compound can be expressed in Joules and can be calculated, experimentally determined, or identified in a standard chemical reference work, such as *Thermochemical Data of Pure Substances* by Ihsan Barin, (1995) 3$^{rd}$ edition, Wiley-VCH Verlag, Weinheim, Germany.

The symbol "ΔH", as used herein, refers to the heat of a chemical reaction, which, for a given chemical reaction, can be can be expressed in Joules and be positive or negative (or 0) and can be calculated, experimentally determined, or identified in a standard chemical reference work, such as *Thermochemical Data of Pure Substances* by Ihsan Barin, (1995) 3$^{rd}$ edition, Wiley-VCH Verlag, Weinheim, Germany.

The symbol "$\Delta_f H$", as used herein, refers to the enthalpy of formation for a chemical compound comprising at least two bonded chemical elements, which for a given chemical compound can be expressed in Joules and can be calculated, experimentally determined, or identified in a standard chemical reference work, such as *Thermochemical Data of Pure Substances* by Ihsan Barin, (1995) 3$^{rd}$ edition, Wiley-VCH Verlag, Weinheim, Germany.

The term "auto-activation temperature", or the symbol "Ta", as can be interchangeably used herein, refers to the temperature at which an SHS reaction between two or more reactant chemical compounds in a mixture can be initiated when the mixture is heated to such temperature. The actual temperature Ta can vary for different combinations of reactant chemical compounds.

The term "chemical compound", as used herein, can refer to a chemical element chemically bonded to one or more other chemical elements.

The term "chemical element", as used herein, refers to any chemical element as set forth in the Periodic Table of Chemical Elements, with which those of skill in the art will be familiar.

The term "metallic compound", as used herein, refers to a chemical compound comprising at least one metallic element, chemically bonded to another chemical element. The metallic element can be bonded to one or more other metallic elements, such as titanium aluminide or nickel aluminide, or the metallic element can be bonded to one or more non-metallic elements, such as aluminum oxide or titanium dioxide, or the metallic element can be bonded to one or more other metallic elements and to one or more non-metallic elements, such as titanium aluminum nitride or titanium aluminide carbide.

The term "metallic element", as used herein, can refer to any one of the following chemical elements: Li, Be, Na, Mg, Al, K, Ca, Sc, Ti, V, Cr, Mn, Fe, Co, Ni, Cu, Zn, Ga, Rb, Sr, Y, Zr, Nb, Mo, Tc, Ru, Rh, Pd, Ag, Cd, In, Sn, Cs, Ba, Hf, Ta, W, Re, Os, Ir, Pt, Au, Hg, Tl, Pb, Bi, Po, Fr, Ra, Rf, Db, Sg, Bh, Hs, Mt, Ds, Rg, Uub, Uut, Uuq, Uup, or any of the lanthanides or actinides.

The term "mixture", as used herein, refers to a composition comprising at least two chemical reactants. The reactants constituting the mixture can be more or less homogenously distributed. Mixtures can comprise solid reactants, for example, particulate compounds. Mixtures can also contain liquid reactants, or liquid reactants with solid reactants dispersed therein.

The term "non-metallic element", as used herein, refers to any chemical element that is not a metallic element.

The term "reinforcement agent", as used herein, refers to a chemical compound conveying a structural or functional material property to a metallic matrix composite upon formation of the composite in an SHS reaction. A reinforcement agent can either chemically react, or not chemically react in an SHS reaction.

Various chemical elements and chemical compositions can be referred herein interchangeably either by using one, two or three letter identifiers for chemical elements in accordance with the Periodic Table of Chemical Elements, or by using their full chemical name, such as: "aluminum" or "Al", "titanium dioxide" or "$TiO_2$", or "aluminum oxide" or "$Al_2O_3$".

All publications, patents and patent applications are herein incorporated by reference in their entirety to the same extent as if each individual publication, patent or patent application was specifically and individually indicated to be incorporated by reference in its entirety.

General Implementation

In overview, it has been realized that a method can be performed to synthesize metallic matrix composites comprising a reinforcement having discrete particles substantially homogenously dispersed within a metallic matrix composite. In some embodiments, the method comprises mixing first and second reactants and an inert nucleator compound to obtain a reaction mixture, and heating the reaction mixture to an auto-activation temperature to initiate a self-propagating high-temperature synthesis reaction between the first and second reactants and thereby produce a metallic matrix composite, the metallic matrix composite comprising a metallic matrix and an in situ formed reinforcement, the reinforcement comprising discrete particles, each of the particles comprising a reinforcement constituent disposed about a core formed of the nucleator compound.

In some embodiments, the metallic matrix composites can exhibit the in situ formed reinforcement phase that is substantially uniformly dispersed within the metallic matrix. Thus, the material properties of the composite can be substantially uniformly distributed within the composite, and the composites can exhibit superior material properties, such as material strength and toughness, rendering the composites of the present disclosure suitable for many science and engineering applications. The reinforcement phase of the composites of the herein provided composites can be comprised of discrete particles. The properties exhibited by the composite can therefore substantially correspond with the properties imparted by the metallic matrix. Furthermore, the occurrence of residual stress caused by a mismatch in thermal expansion between the metallic matrix material and reinforcement material can be relatively rare. The methods of the present disclosure can therefore be implemented in a manner that results in relatively few article rejects due fractured materials, or materials suffering from catastrophic failure.

Various techniques can be used to initiate the metallic matrix composite forming reaction of the present disclosure. Each of the techniques provided herein involve the preparation of a mixture comprising the constituents required to form the metallic matrix composite of the present disclosure. The mixture is then reacted, as hereinafter described, and in the reaction the metallic matrix composite is formed.

Figure 4:
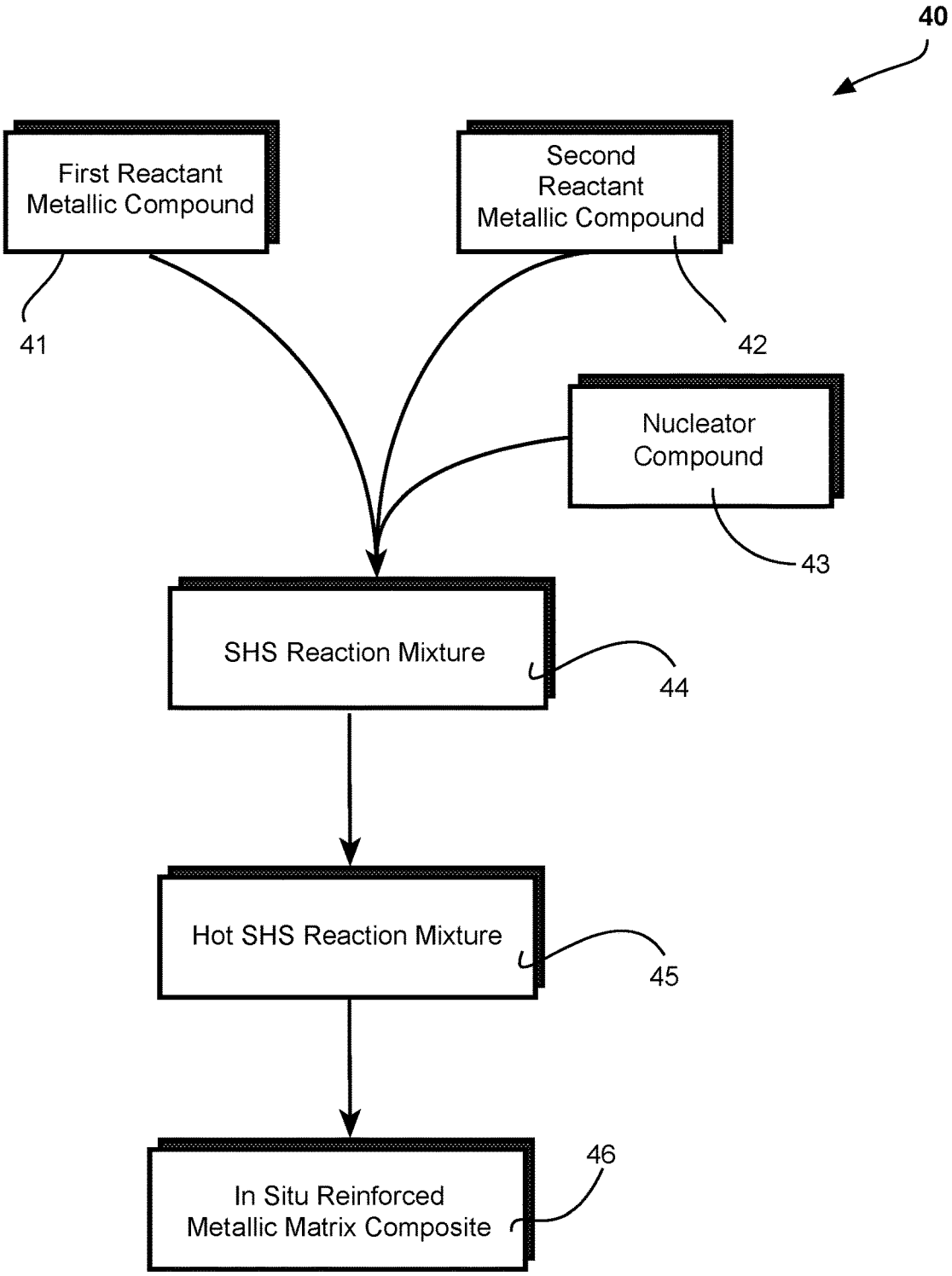
FIG. 4 is a schematic block diagram illustrating an example of a method of making a metallic matrix composite.

Referring now to FIG. 4, a method 40 is shown for preparing a metallic matrix compound comprising an in situ formed reinforcement phase 46. Method 40 can comprise a first step comprising providing first reactant 41, provided in the form or a metallic element or a metallic compound, and second reactant 42, provided substantially in the form of a metallic element or metallic compound and mixing the two reactants 41 and 42 in the presence of inert nucleator compound 43 to form SHS reaction mixture 44. Method 40 can next comprise a second step comprising increasing the temperature of SHS reaction mixture article 44 to obtain hot SHS reaction mixture 45 having a temperature equal to the auto-activation temperature. Method 40 can next comprise a third step comprising reacting first reactant 41 and second reactant 42 in an SHS reaction to form metallic matrix compound comprising an in situ formed reinforcement phase 46. As hereinafter provided in further detail, the nucleator compound can be selected to permit the formation of discrete particles comprising reinforcement constituent disposed about a core of nucleator compound. The individual discrete particles representing the reinforcement phase can be about 3 μm or less and can be uniformly dispersed within the metallic matrix. The SHS reaction can be characterized by a $\Delta H<0$ and a $\Delta G<0$. The first reactant, or the second reactant, or the first and second reactant can be provided substantially in the form of a metallic element bonded to a non-metallic element. The nucleator compound can comprise the same non-metallic element. The $\Delta G^{\ddagger}$ and the $\Delta_f G$ of the nucleator compound can exceed the $\Delta G^{\ddagger}$ and the $\Delta_f G$, respectively, of the first reactant, or the second reactant, or the first and second reactant.

To initiate the methods provided in the present disclosure, a first reactant and a second reactant can be provided or obtained. A variety of first and second reactant metallic compounds can be selected. In general, the first and second reactants selected to conduct a method herein can be capable of forming a product metallic matrix compound, comprising a metallic matrix and a reinforcement phase, pursuant to a chemical reaction exhibiting a $\Delta G<0$ and a $\Delta H<0$. The $\Delta G$ or $\Delta H$ of a given chemical reaction between a first and second reactants can be determined with reference to standard chemical literature documenting physical and chemical properties of chemical compounds, for example, *Thermochemical Data of Pure Substances* by Ihsan Barin, (1995) 3rd edition, Wiley-VCH Verlag, Weinheim, Germany. Alternatively, the $\Delta G$ or $\Delta H$ can be experimentally determined, for example, as described in: *An Introduction to Chemical Metallurgy: International Series on Materials Science and Technology* Volume 26 of International series on materials science and technology; Pergamon international library of science, technology, engineering and social studies, R. H. Parker and D. W. Hopkins (2016), $2^{nd}$ revised edition, Elsevier, and many publications on the subject of chemical thermodynamics, as will be known by those of skill in the art. In some embodiments, the first reactant can be a reactant metallic element.

The form or state in which the first or second reactants can be obtained or provided can vary. In some embodiments, at least one of the first reactant and the second reactant metallic compound is provided in a solid state.

The purity of the first and second reactant can vary, however the first and second reactant are generally substantially pure and constituted to comprise at least 95% (w/w) of the reactant. In some embodiments, the purity is at least about 98%, at least about 99%, at least about 99.9% or at least about 99.99%. In such embodiments, the metallic element or the metallic compound comprises at least about 98% (w/w), at least about 99% (w/w), at least 99.9% (w/w), or at least 99.99%, respectively, of the first or the second reactant, respectively. The material balance can comprise trace metallic compounds, for example, trace metallic elements.

In some embodiments, the first metallic compound or metallic element can have a lower melting point than the second metallic compound or metallic element, for example, the first metallic compound or metallic element can have a melting point of about 10° C., about 25° C., about 50° C., about 100° C., about 150° C., about 200° C., or about 250° C. below the melting point of the second metallic compound or metallic element.

In embodiments wherein a reactant is provided in solid form, the reactants can be provided or obtained in particulate form. The particulates can have a range of particle sizes. In some embodiments, the mean particle size of first or second particulates can range from about 1 μm to about 100 μm, inclusive. The mean particle size can be, for example, be about 5 μm, about 10 μm, about 15 μm, about 20 μm, about 25 about m, 30 μm, 35 μm, 40 μm, 45 μm, 50 μm, 55 μm, 60 μm, 65 μm, 70 μm, 75 μm, 80 μm, 85 μm, 90 μm, 95 μm or about 100 μm. In some embodiments, the mean particle size of the second particulate can range from about 0.1 μm to about 3 μm, inclusive, for example, the mean particle size can be about 0.1 μm, about 0.25 μm, about 0.5 μm, about 0.75 μm, about 1 μm, about 1.5 μm, about 2 μm about 2.5 μm or about 3 μm. In some embodiments, the mean particle size of the first particulate reactant can be at least about 3× the particle size of the second particulate reactant, for example, the mean particle size of the first particulate can be about 3×, about 4×, about 5×, about 6×, about 7×, about 8×, about 9×, about 10×, about 15×, about 20× or about 30× the mean particle size of the second particulate reactant. The particles can be homogenously sized, i.e. the particles can have a tightly centered mean particle size, e.g., 90% of the particles can have a particle size not exceeding ±20% of the mean particle size, or 90% of the particles can have a particle size not exceeding ±10%, the particles can have a not exceeding ±5% of the mean particle size.

In some embodiments, the first reactant can be a metallic compound provided substantially in the form of two or more bonded metallic elements.

In some embodiments, the second reactant can be a metallic compound provided substantially in the form of two or more bonded metallic elements.

In some embodiments, the first and second reactants can be metallic compounds each provided substantially in the form of two or more bonded metallic elements.

In some embodiments, the first reactant can be a metallic compound provided substantially in the form of a metallic chemical element bonded to a non-metallic chemical element.

In some embodiments, the second reactant can be a metallic compound provided substantially in the form of a metallic chemical element bonded to a non-metallic chemical element.

In some embodiments, the first and the second reactants can be metallic compounds provided substantially in the form of a metallic chemical element bonded to a non-metallic chemical element.

In some embodiments, the first reactant can be a metallic element selected from the group consisting of Ag, Al, Fe, Mg, Ni, and Ti.

In some embodiments, the second reactant can be a metallic element selected from the group consisting of Ag, Al, Fe, Mg, Ni, and Ti.

In some embodiments, the first and the second reactants can be metallic elements selected from the group consisting of Ag, Al, Fe, Mg, Ni, and Ti.

In some embodiments, the first reactant can be a metallic compound provided substantially in the form of a metallic element selected from the group consisting of Ag, Al, Fe, Mg, Ni, and Ti, the metallic element bonded to another metallic element.

In at least one embodiment, the second reactant can be a metallic compound provided substantially in the form of a metallic element selected from the group consisting of Ag, Al, Fe, Mg, Ni, and Ti, the metallic element bonded to another metallic element.

In some embodiments, the first and the second reactants can be metallic compounds provided substantially in the form of a metallic element selected from the group consisting of Ag, Al, Fe, Mg, Ni, and Ti, the metallic element bonded to another metallic element.

In some embodiments, the first reactant can be a metallic compound provided substantially in the form of a metallic element selected from the group consisting of Ag, Al, Fe, Mg, Ni, and Ti, the metallic element bonded to a non-metallic element.

In some embodiments, the second reactant can be a metallic compound provided substantially in the form of a metallic element selected from the group consisting of Ag, Al, Fe, Mg, Ni, and Ti, the metallic element bonded to a non-metallic element.

In some embodiments, the first and the second reactants can be metallic compounds provided substantially in the form of a metallic element selected from the group consisting of Ag, Al, Fe, Mg, Ni, and Ti, the metallic element bonded to non-metallic element.

In some embodiments, the first reactant can be a metallic compound selected from the group consisting of a metal boride, a metal carbide, a metal nitride, a metal oxide, and a metal silicide.

In some embodiments, the second reactant can be a metallic compound selected from the group consisting of a metal boride, a metal carbide, a metal nitride, a metal oxide, and a metal silicide.

In some embodiments, the first and second reactant can be metallic compounds each selected from the group consisting of a metal boride, a metal carbide, a metal nitride, a metal oxide, and a metal silicide.

Next, the first reactant compound and second reactant can be mixed, by contacting the first and second reactants in a suitable receptacle and mixing the two compounds. In order to mix the reactants, a stirring or blending device suitable for mixing the reactants can be used, for example, a mechanical mixing device, such as a ball mill can be used to mix particulates. Suitable receptacles include containers or vessels that can withstand temperatures used in subsequent heating steps, including containers or vessels made from heat resistant materials such as porcelain, graphite or an inert metal. In some embodiments, contacting and mixing of the first and second reactants can be conducted at room temperature. In some embodiments, contacting and mixing of the first and second reactants can be conducted at elevated temperatures. Notably in embodiments in which a molten reactant is used temperatures can be elevated to, for example, at least about 200° C., about 300° C., about 400° C., about 500° C., about 600° C., about 700° C., or about 800° C. Upon mixing of the first and second reactants a more or less homogenous mixture comprising a first reactant and a second reactant can be obtained.

In embodiments wherein the first and second reactants are provided as particulates, the first and reactants can be compacted to form a powder compact or preform. The particulate mixture can be compacted or preformed by compressing the particulate mixture in a die at a force of a sufficient magnitude to bind the first and second reactants, and thereby form a powder compact or preform. Thus, for example, a cylindrical sleeve, such as a cylindrical steel sleeve, can be used as a receptacle for a particular blend. A cylinder, such as a solid steel cylinder, that matchingly fits in the sleeve can then be used to mediate a compressive force on the particulate blend. The compressive force can be exerted by a mechanical device. For example, the compressive force can be exerted by a mechanical or a hydraulic press. In some embodiments, the powder compact or preform can be formed at room temperature, in other embodiments, the powder compact or preform can be formed at elevated temperatures, for example, in a furnace.

The relative quantities of first and second reactant used for mixing can vary. In some embodiments, the quantities can be selected with reference to the chemical reaction conducted. In some embodiments, quantities of the first and second reactant can correspond with stoichiometric quantities of a first and second reactant. Thus, for example, in a method conducted using aluminum and titanium dioxide in accordance with the following chemical reaction:

$$7Al+3TiO_2 \rightarrow 3TiAl+2Al_2O_3 \qquad \text{reaction (I);}$$

an amount of first reactant comprising 7 molar equivalents of aluminum and an amount of second reactant comprising 3 molar equivalents of titanium dioxide can be selected. In some embodiments, the reactants can be reacted to off-stoichiometry.

Next, or in some embodiments, in conjunction with mixing of the first and second reactants, an inert nucleator compound is contacted with the mixture comprising a first and second reactant in order to obtain a pre-SHS mixture. With the term "inert", as used herein, it is meant that the nucleator compound does not substantially react with either the first reactant, or the second metallic reactant in the subsequently performed SHS reaction. It is noted, however, that it is possible that a nucleator compound can react in an SHS reaction wherein the nucleator compound is combined with either the first reactant alone, or the second reactant alone.

A nucleator compound can comprise a metallic compound and is provided or obtained substantially in the form of a nano-sized particulate, i.e. a particulate having a mean average particle size of no more than about 1 μm, or about 750 nm, or about 500, nm, or about 250, or about 100 nm, or about 90 nm, or about 80 nm, or about, 70 nm, or about 60 nm, about 50 nm, about 40 nm, about 30 nm, about 20 nm or about 10 nm. The nucleator compound can be contacted with the first reactant compound, the second reactant metallic compound, or with a mixture comprising both reactant metallic compounds and mixed using mixing, stirring or blending equipment, for example, a ball mill until a more or less homogenous mixture comprising the first reactant metallic compound, the second reactant metallic compound and the nucleator compound is obtained. The quantities of nucleator compound that can be used can vary, but nucleator compound quantities are typically substantially less than the first metallic compound or the second metallic compound. In some embodiments, the mixture comprises from about 0.5% (w/w) to about 5% (w/w) of the nucleator compound, for example, about 1% (w/w), 2% (w/w), 3% (w/w) or 4% (w/w).

In some embodiments, at least one of the first and second reactants can be provided substantially in the form of a metallic element bonded to a non-metallic element, and the nucleator compound can comprise the same non-metallic element. Thus, for example, with respect to an embodiment involving the performance of reaction (I), the second reactant can be said to be $TiO_2$, and the nucleator compound can comprise an oxide, and can be, for example, $ZrO_2$.

In some embodiments, the first reactant can be provided substantially in the form of a first metallic element bonded to a first non-metallic element, the second reactant can be provided substantially in the form of a second metallic element bonded to a second non-metallic element, and a first nucleator compound can comprise the same first non-metallic element, and a second nucleator compound can comprise the same second non-metallic element.

In some embodiments, the $\Delta_f H$ of a metallic compound consisting of the metallic element of a nucleator compound bonded to a metallic element constituting the first reactant minus the $\Delta_f H$ of the nucleator compound, is larger than the $\Delta_f H$ of the compound forming the metallic matrix minus the $\Delta_f H$ of the compound forming the reinforcement.

In some embodiments, the $\Delta_f G$ of a metallic compound consisting of the metallic element of the nucleator compound bonded to a metallic element constituting the first reactant minus the $\Delta_f G$ of the nucleator compound, is larger than the $\Delta_f G$ of the compound forming the metallic matrix minus the $\Delta_f G$ of the compound forming the reinforcement.

Thus, in embodiments involving the performance of an example reaction (I), using $ZrO_2$ as a nucleator compound:

$$\Delta fH(\text{ZrAl})-\Delta fH(\text{ZrO}_2)>\Delta fH(\text{TiAl})-\Delta fH(\text{TiO}_2).$$

Therefore, $ZrO_2$ can be used as a nucleator compound in accordance with this embodiment.

Thus, in an embodiment involving the performance of an example reaction (I), using $ZrO_2$ as a nucleator compound:

$$\Delta fG(\text{ZrAl})-\Delta fG(\text{ZrO}_2)>\Delta fG(\text{TiAl})-\Delta fG(\text{TiO}_2).$$

Therefore, $ZrO_2$ can be used as a nucleator compound in accordance with this embodiment.

Figure 5:
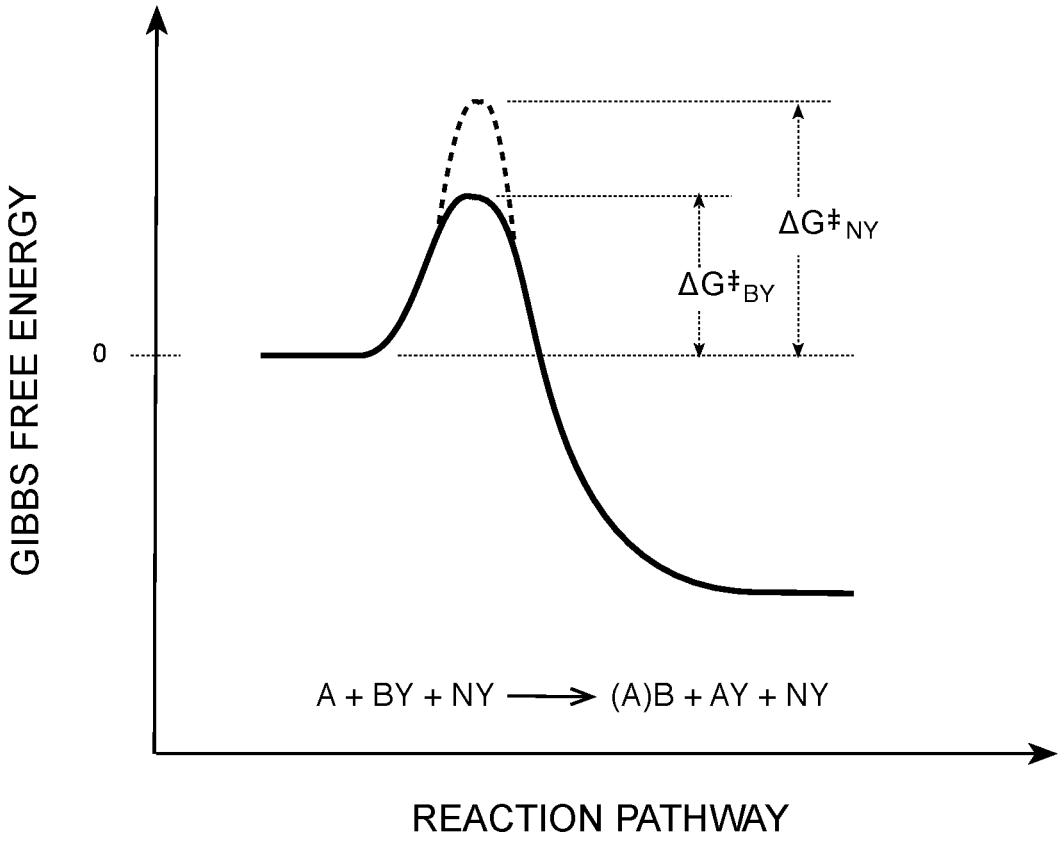
FIG. 5 is a graph illustrating, in general, the Gibbs free energy (ΔG) of a chemical reaction, performed in accordance with an embodiment of the present disclosure. The reaction involves the formation of metallic matrix compound (A)B reinforced with reinforcement phase AY formed about nucleator compound NY from reactant metallic compounds A and BY as a function of the reaction pathway, wherein the reaction has a negative ΔG, i.e. the reaction is spontaneous. The amount of energy necessary to cause the reaction to proceed from its ground state to its transition state is denoted as Gibbs free energy of activation ($\Delta G^{\ddagger}_{BY}$). Further indicated is the amount of energy necessary to cause a reaction to proceed from its ground state to its transition state to form compound NY and denoted as Gibbs free energy of activation ($\Delta G^{\ddagger}_{NY}$).
Figure 6:
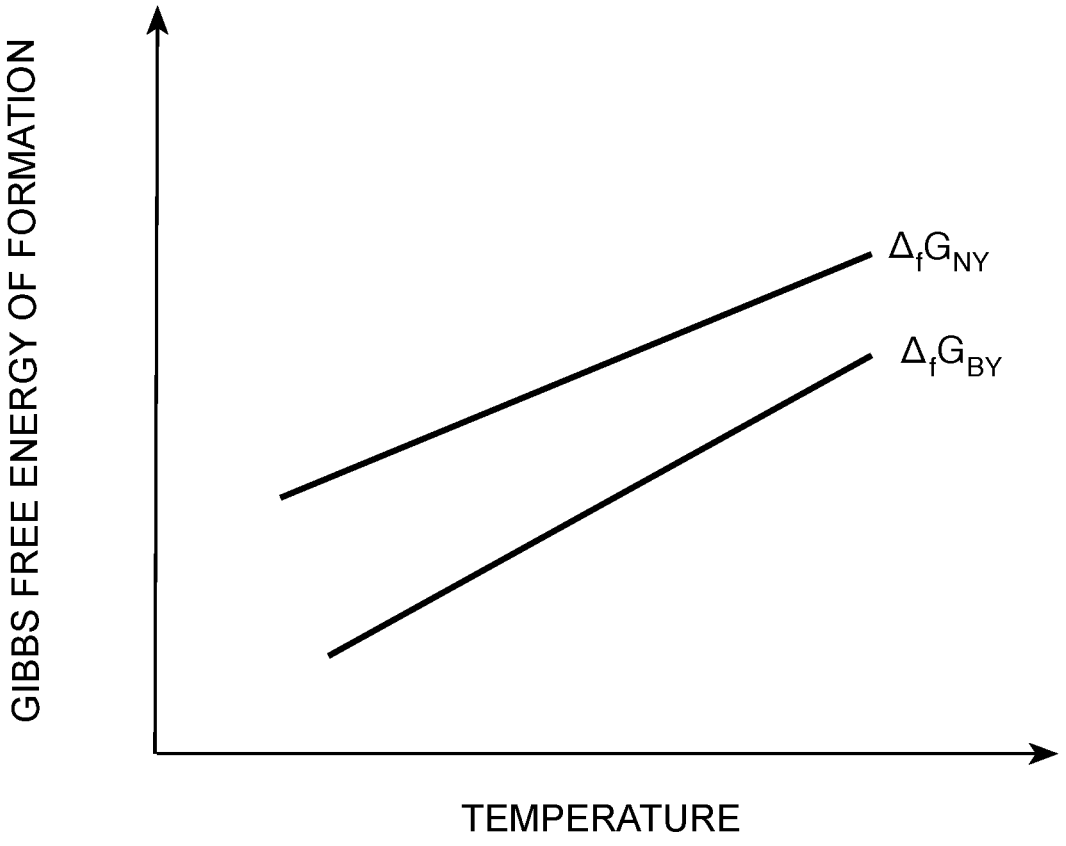
FIG. 6 is a graph illustrating the $\Delta_f G_{BY}$ and $\Delta_f G_{NY}$ as a function of temperature relating to the formation of compound reactive metallic compound BY and nucleator compound NY, respectively.

Without wishing to be bound by theory, some of the foregoing principles are further illustrated with reference to FIGS. 5 and 6. Shown in FIG. 5 is a graph illustrating, in general, the Gibbs free energy (ΔG) of chemical reaction:

$$A+BY+NY \rightarrow (A)B+AY+NY \qquad \text{reaction (II).}$$

In reaction (II), "A" is a reactive metallic element, "BY" is a reactive metallic compound, wherein "B" is a metallic element bonded to a non-metallic element "Y", "(A)B+AY+NY" together is a metallic matrix compound in situ reinforced by a reinforcement phase, wherein "(A)B" is a metallic matrix, "AY" is a reinforcement phase and "NY" is an inert nucleator compound. Reaction (II) has a negative ΔG, i.e. the reaction is spontaneous. The amount of energy necessary to cause the reaction to proceed from its ground state to its transition state i.e. the Gibbs free energy of activation is $\Delta G^{\ddagger}_{BY}$ and the Gibbs free energy of activation for nucleator compound NY is $\Delta G^{\ddagger}_{NY}$. As can be appreciated from the graph in FIG. 5, for reaction (II), $\Delta G^{\ddagger}_{BY}<\Delta G^{\ddagger}_{NY}$. Thus, NY will not substantially participate in a reaction between "A" and "BY". Shown in FIG. 6, relating to the same reaction (II), is a graph illustrating the $\Delta_f G_{BY}$ and $\Delta_f G_{NY}$ as a function of temperature relating to the formation of compound reactive metallic compound "BY" and nucleator compound "NY", respectively. The temperature range shown is intended to correspond with the temperature occurring during performance of an SHS reaction corresponding with reaction (II). As can be appreciated from FIG. 6, the $\Delta_f G_{NY}>\Delta_f G_{BY}$ at all temperatures across the temperature range. Thus, a reaction between first reactant metallic compound "A" and second reactant metallic compound "BY" is favored over a reaction between reactant metallic element "A" and nucleator compound "NY".

In some embodiments, the first reactant, or the second reactant, or the first and second reactant metallic can be provided substantially in the form of a metallic chemical element bonded to a non-metallic element, and the nucleator compound can comprise the non-metallic element, wherein the non-metallic element is B, C, N, or O.

In some embodiments, the nucleator compound can comprise a divalent metallic element.

In some embodiments, the nucleator compound can consist substantially of a divalent metallic element bonded to a non-metallic element.

In some embodiments, the nucleator compound can consist substantially of a divalent metallic element bonded to a non-metallic element selected from the group consisting of B, C, N and O.

In some embodiments, the nucleator compound can comprise the metallic element Zr.

In some embodiments, the nucleator compound can comprise the chemical element B.

In some embodiments, the nucleator compound can be selected from the group consisting of $B_4C$, $ZrB_2$, $ZrO_2$ and $ZrO_2$-3Y.

In some embodiments, one or more additional additive agents can be included in the pre-SHS mixture. Additive agents can be included in conjunction with the first reactant metallic compound, the second reactant metallic compound or the nucleator compound, or the one or more additive agents can be included following mixing of the first reactant, the second reactant and the nucleator compound. Generally only small amounts of additive agents are included, so that they constitute no more than about 5% (w/w), about 4% (w/w), about 3% (w/w), about 2% (w/w), or about 1% (w/w) of the pre-SHS mixture.

In some embodiments, additive agents can be agents facilitating one or more of the method steps, without conveying structural or functional material properties to the metallic matrix compound formed in the SHS reaction. In some embodiments, the additive agent can be a surfactant to facilitate a mixing step, for example, an organic solvent, such as acetone or isopropyl alcohol. In other embodiments, the additive agent can be a binder, such as an inorganic binder, for example, magnesium aluminum silicate, or an organic binder, such as carboxymethylcellulose, which can be used to facilitate a preforming step.

In some embodiments, additive agents can be alloying chemical elements. In some embodiments, an alloying chemical element can be included in a mixture by providing or obtaining a metallic compound constituting an alloy. Examples of alloying elements that can be included are elemental Ag, Al, Fe, Mg, Ni, or Ti.

Additive agents can be included in the mixture in any desired form or constitution, for example, as a particulate or a liquid.

Next, the pre-SHS mixture is heated to increase the temperature to the auto-activation temperature $T_a$. This can involve, increasing the temperature of the pre-SHS mixture starting from ambient temperature, for example, by placing the pre-SHS mixture being held in a heat resistant receptacle, such as a steel container, in a temperature controlled metallurgical furnace capable of heating the pre-SHS mixture to a temperature $T_a$. In some embodiments, the temperature of the pre-SHS mixture can be increased under ambient atmospheric conditions. In some embodiments, the temperature of the pre-SHS mixture can be increased under controlled atmospheric conditions, for example, in a furnace in which the flow of an inert gas, such as nitrogen or argon, can be controlled.

The temperature $T_a$ for different combinations of first and second reactants can vary. $T_a$ values are generally at least about 100° C., and in different embodiments can be at least about 250° C., at least about 500° C., at least about 750° C., at least about 1,000° C., or at least about 1,250° C. The activation temperature $T_a$ for a given combination of a selected first reactant and a second reactant can be obtained with reference to standard chemical reference books, for example, *Thermochemical Data of Pure Substances* by Ihsan Barin, (1995) 3rd edition, Wiley-VCH Verlag, Weinheim, Germany. Alternatively, the ΔG or ΔH can be experimentally determined, for example, as described in: *An Introduction to Chemical Metallurgy: International Series on Materials Science and Technology Volume* 26 of International series on materials science and technology; Pergamon international library of science, technology, engineering and social studies, R. H. Parker and D. W. Hopkins (2016), 2nd revised edition, Elsevier, and many publications on the subject of chemical thermodynamics, as will be known by those of skill in the art.

In some embodiments, as the temperature is increased, the first reactant can liquefy so that at a temperature $T_a$ the first reactant is extant in molten form.

In some embodiments, as the temperature is increased, the second reactant can liquefy so that at a temperature $T_a$ the second reactant is extant in molten form.

In some embodiments, as the temperature is increased, the first reactant and the second reactant can liquefy so that at a temperature $T_a$ the first reactant and the second reactant are extant in liquid form.

In some embodiments, as the temperature is increased, the first reactant and second reactant remain extant in solid form.

As the temperature of the reaction mixture reaches the auto-activation temperature $T_a$, a chemical reaction between the first and second reactant can initiate. Once the initial reaction has occurred, the heat released by the exothermic reaction causes additional diffusion of reactive components and the reaction can proceed. During the initiation and reaction extremely high temperatures, for example, temperatures in excess of 1,000° C., 1,250° C. or 1,500° C. can be achieved in very short periods of time, for example, less than 1 second. During this time frame, approximately all of the first and second reactive react and a metallic matrix reaction product and reinforcement phase are formed. When all reactants have been consumed and the reaction is complete, there is no further energy to maintain the high temperatures and of the mixture will gradually start to come down. The mixture can then for a period of time be cooled down to ambient temperature. This can optionally be done in a controlled manner, for example, by conducting the reaction in a temperature controlled tool.

The techniques used to conduct an SHS reaction in accordance herewith, including the arrangement of parts and tools, reaction conditions, details and order of operation can be varied. Some techniques to conduct SHS reactions that can be used, in accordance herewith, are detailed in U.S. Pat. No. 4,916,029 (Nagle et al.), 5,059,490 (Brupbacher et al.) and 6,955,532 (Zhu et al.), PCT Patent Application WO 02/053316 (Lintunen et al.), and Horvitz et al., 2002, J. European Ceramic Society 22, 947-954, as well as the techniques described in U.S. Patent Application Nos. 62/331,507, 62/331,576; and/or 62/331,570, or any patent applications or patents deriving priority therefrom.

Figure 7:
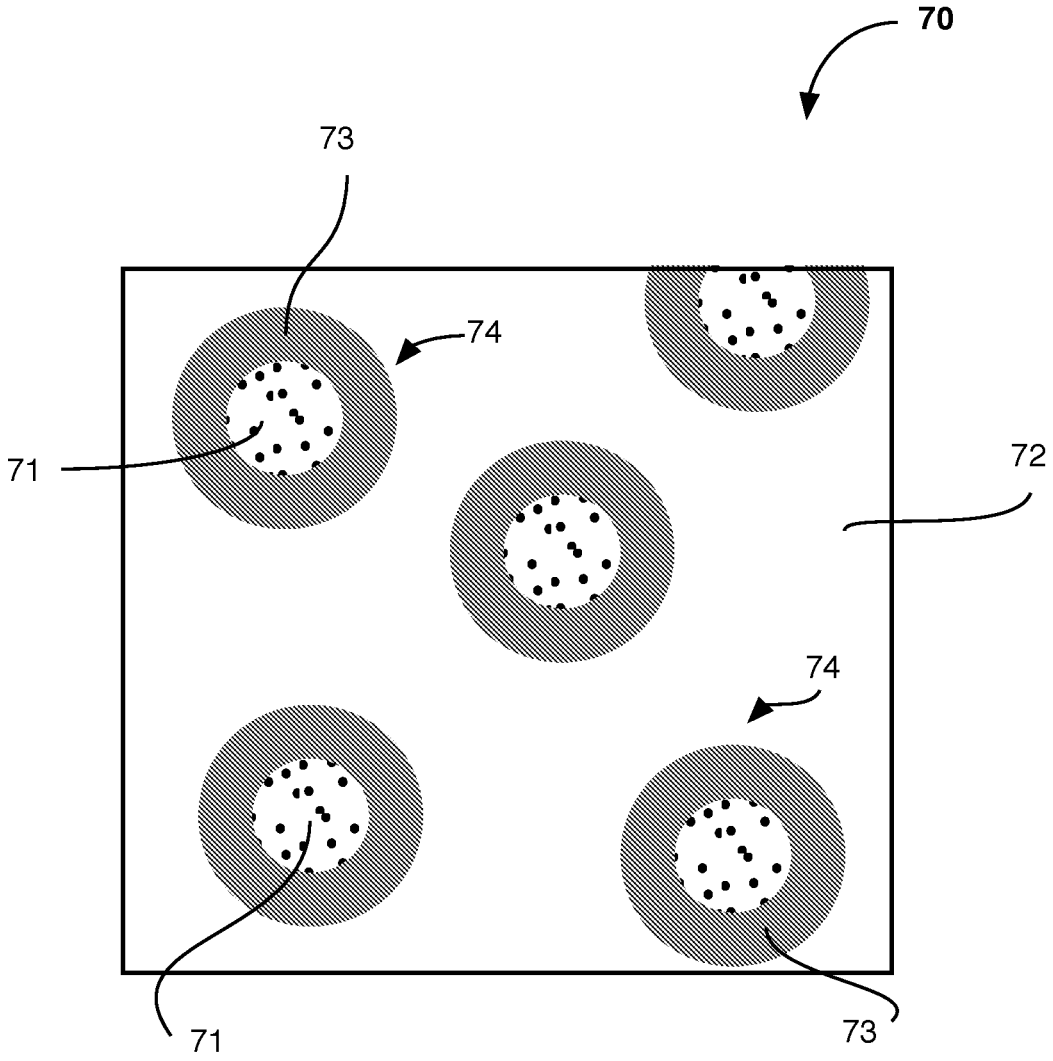
FIG. 7 is a sketch of a cross-sectional microscopic view of a metallic matrix composite material made in accordance with the present disclosure.

The product now formed is a metallic matrix composite with an in situ formed reinforcement phase substantially uniformly dispersed therein. Referring now to FIG. 7, shown therein is a sketch of a microscopic view of a section of metallic matrix composite 70 synthesized in accordance with the present disclosure. Composite 70 comprises metallic matrix phase 72 in which discrete particles 74 constituting an in situ formed reinforcement phase have been substantially uniformly dispersed. Particles 74 are comprised of core 71 comprising a nucleator compound, and more or less circumferentially disposed about core 71 reinforcement constituent 73. Referring to reaction (II) above, metallic matrix phase 72 is constituted of compound "(A)B", while the particles 74 are constituted of core 71 constituted of compound "NY", and reinforcement constituent constituted of compound "AY". The reinforcement particles constituting the in situ formed reinforcement phase can vary in size, but generally do not have a mean particle size larger than about 3 μm, about 2.5 μm, about 2.0 μm, about 1.5 μm, about 1 μm, about 0.9 μm, about 0.8 μm, about 0.7 μm, about 0.6 μm, or about 0.5 μm. The mean size of the core of the particles is, of course, smaller than the average particle size and can be for example, no larger than about 2.5 μm, about 2.0 μm, about 1.5 μm, about 1.0 μm, about 0.8 μm, about 0.7 μm, about 0.6 μm, about 0.5 μm, about 0.4 μm, about 0.3 μm, about 0.2 μm, or about 0.1 μm. The reinforcement particles can be homogenously sized, i.e. the reinforcement particles can have a tightly centered mean particle size, e.g., 90% of the particles can have a particle size not exceeding ±20% of the mean particle size, or 90% of the particles can have a particle size not exceeding ±10%, the particles can have a not exceeding ±5% of the mean particle size.

In some embodiments, the first reactant can be a metallic element, the nucleator compound can be a metallic element bonded to a non-metallic element, and the $\Delta_f H$ of a metallic compound consisting of the metallic element of the nucleator compound bonded to the metallic element of the first reactant minus the $\Delta_f H$ of the nucleator compound, is larger than the $\Delta_f H$ of the compound forming the metallic matrix phase minus the $\Delta_f H$ of the compound forming the reinforcement phase.

In some embodiments, the first reactant can be a metallic element, the nucleator compound can be a metallic element bonded to a non-metallic element, and can the $\Delta_f G$ of a metallic compound consisting of the metallic element of the nucleator compound bonded to the metallic element of the first reactant minus the $\Delta_f G$ of the nucleator compound, is larger than the $\Delta_f G$ of the compound forming the metallic matrix minus the $\Delta_f G$ of the compound forming the reinforcement.

In some embodiments, the first reactant metallic compound can be Al, the second reactant metallic compound can be $TiO_2$, and the metallic matrix composite compound can comprise or consist of a metallic matrix composite comprising TiAl in situ reinforced with $Al_2O_3$.

In some embodiments, the first reactant metallic compound can be Al, the second reactant metallic compound can be $TiO_2$, the metallic matrix composite compound can comprise or consist of a metallic matrix composite comprising TiAl in situ reinforced with $Al_2O_3$, and the nucleator compound can be $ZrO_2$ or $ZrO_2$-3Y.

The metallic matrix compounds of the present disclosure can be made in a wide variety of three-dimensional geometries. For example, in embodiments hereof wherein the mixture is provided as a preform, such preform can be provided in a near net shape, and reacted in a corresponding die. Following completion of an SHS reaction, a finished shaped article constituted of the metallic matrix composited can be obtained. Thus, a wide variety of shaped articles of manufacture can be fabricated in accordance herewith. Accordingly, the present disclosure further includes uses of metallic matrix composites to make an article of manufacture. In some embodiments, the article of manufacture can be an automotive part, for example, a break rotor or a light weight actuator. In some embodiments, the article of manufacture can be an aeronautical part. In some embodiments, the article of manufacture can be an armory part, for example, tiles for ballistic armour.

It will be clear from the foregoing that the methods of the present disclosure can be conducted by providing a wide variety of combinations of reactant metallic compounds in conjunction with nucleator compounds, and the methods can also yield a wide variety of product metallic matrix compounds. The following chemical reactions are provided by way of example only, each reaction representing a different embodiment hereof. It will be understood by those of skill in the art that using the methods of the present disclosure, starting with the reactant metallic compounds set out in these chemical reactions, metallic matrix composites comprising an in situ formed reinforcement phase dispersed substantially in the form of discrete particles within the metallic matrix can be synthesized. These example reactions are intended to be illustrative and in no way limiting. It can be understood by those of skill in the art that the methods described herein can be conducted to make metallic matrix composites constituted of a wide variety of other metallic compounds, using a wide variety of reactant metallic compounds and nucleator compounds.

Implementation of Specific Example Chemical Reactions

An example embodiment using aluminum and titanium dioxide as reactants and zirconium dioxide as a nucleator compound:

$$7Al+3TiO_2+ZrO_2 \rightarrow 3TiAl+2Al_2O_3+ZrO_2-\Delta H.$$

An example embodiment using aluminum and titanium dioxide as reactants and zirconia-yttria as a nucleator compound:

$$7Al+3TiO_2+ZrO_2\text{-}3Y \rightarrow 3TiAl+2Al_2O_3+ZrO_2\text{-}3Y-\Delta H.$$

An example embodiment using titanium and silicon carbide as reactants and boron carbide as a nucleator compound:

$$8Ti+3SiC+xB_4C \rightarrow Ti_5Si_3+3TiC+xB_4C.$$

As now can be appreciated, the methods described herein can be used to synthesize metallic matrix composites having a reinforcement phase comprised of discrete particles substantially uniformly dispersed therein. The composites provided herein exhibit material properties that correspond to a substantial degree with the material properties of the metallic matrix. The methods can be applied to make various composite metallic matrix compounds.

Of course, the above described example embodiments of the present application are intended to be illustrative only and in no way limiting. The described embodiments are susceptible to many modifications of form, arrangement of parts, details and order of operation. The disclosure, rather, is intended to encompass all such modifications within its scope, as defined by the claims, which should be given a broad interpretation consistent with the description as a whole.

The above disclosure generally describes various aspects of methods and compositions of the present disclosure. A more complete understanding can be obtained by reference to the following specific examples. These examples are described solely for the purpose of illustration and are not intended to limit the scope of the disclosure. Changes in form and substitution of equivalents are contemplated as circumstances might suggest or render expedient. Although specific terms have been employed herein, such terms are intended in a descriptive sense and not for purposes of limitation.

EXAMPLES

Example 1

A mixture of commercially pure (99.7%) aluminum (Al) powder with a mean particle size of 45 μm, commercially pure (98.0%) rutile titanium dioxide ($TiO_2$) powder with a mean particle size of 0.35 μm, and a nucleator compound of 2% (by weight) commercially pure (99.0%) zirconium dioxide ($ZrO_2$) powder with a mean particle size of 40 nm, was fully blended by way of ball milling in acetone. The Al and $TiO_2$ were combined at a molar ratio of 7:3 according to the stoichiometry of the following SHS reaction:

$$7Al+3TiO_2+(0.07)ZrO_2 \rightarrow 3TiAl+2Al_2O_3+(0.07)ZrO_2-\Delta H.$$

After blending, the powder mixture was dried and sieved with a #200 Standard US sieve (0.074 millimeters) in order to remove any large aggregates. The powder mixture was then pressed to 10 megapascals (MPa) at room temperature to a disk approximately 50 millimeters in diameter by 10 millimeters thick. The disk was then placed in a standard tube furnace with an argon atmosphere and heated until activation of the SHS reaction, which occurred at approximately 920° C. The synthesized disk of metallic matrix composite and uniform reinforcement phase did not crack or suffer catastrophic failure upon cooling to room temperature. X-ray diffraction analysis after synthesis found the titanium aluminide phase TiAl and the aluminum oxide reinforcement phase $Al_2O_3$.

Example 2

A mixture of commercially pure (99.7%) aluminum (Al) powder with a mean particle size of 45 μm, commercially pure (98.0%) rutile titanium dioxide ($TiO_2$) powder with a mean particle size of 0.35 μm, and a nucleator compound of 2% (by weight) commercially pure (99.0%) zirconium dioxide ($ZrO_2$) powder with a mean particle size of 40 nm, was fully blended by way of ball milling in acetone. The Al and $TiO_2$ were combined at a molar ratio of 7.07:3.21 (i.e. Al content below stoichiometry).

After blending, the powder mixture was dried and sieved with a #200 Standard US sieve (0.074 millimeters) in order to remove any large aggregates. The powder mixture was then pressed to 10 megapascals (MPa) at room temperature to a disk approximately 50 millimeters in diameter by 10 millimeters thick. The disk was then placed in a standard tube furnace with an argon atmosphere and heated until activation of the SHS reaction, which occurred at approximately 920° C. The synthesized disk of metallic matrix composite and uniform reinforcement phase did not crack or suffer catastrophic failure upon cooling to room temperature. X-ray diffraction analysis after synthesis found the titanium aluminide phase TiAl and the aluminum oxide reinforcement phase $Al_2O_3$.

Example 3

A mixture of commercially pure (99.7%) aluminum (Al) powder with a mean particle size of 45 μm, commercially pure (98.0%) rutile titanium dioxide ($TiO_2$) powder with a mean particle size of 0.35 μm, and a nucleator compound of 0.8% (by weight) commercially pure (99.0%) zirconium dioxide ($ZrO_2$) powder with a mean particle size of 40 nm, was fully blended by way of ball milling in acetone. The Al and $TiO_2$ were combined at a molar ratio of 7.07:3.21 (i.e. Al content below stoichiometry).

After blending, the powder mixture was dried and sieved with a #200 Standard US sieve (0.074 millimeters) in order to remove any large aggregates. The powder mixture was then pressed to 10 megapascals (MPa) at room temperature to a disk approximately 50 millimeters in diameter by 10 millimeters thick. The disk was then placed in a standard tube furnace with an argon atmosphere and heated until activation of the SHS reaction, which occurred at approximately 920° C. The synthesized disk of metallic matrix composite and uniform reinforcement phase did not crack or suffer catastrophic failure upon cooling to room temperature. X-ray diffraction analysis after synthesis found the titanium aluminide phase TiAl and the aluminum oxide reinforcement phase $Al_2O_3$.

Example 4

A mixture of commercially pure (99.7%) aluminum (Al) powder with a mean particle size of 45 μm, commercially pure (98.0%) rutile titanium dioxide ($TiO_2$) powder with a mean particle size of 0.35 μm, and a nucleator compound of 2% (by weight) commercially pure (99.0%) zirconia-yttria ($ZrO_2$-3Y) powder with a mean particle size of 20 nm, was fully blended by way of ball milling in acetone. The Al and $TiO_2$ were combined at a molar ratio of 7.07:3.21 (i.e. Al content below stoichiometry).

After blending, the powder mixture was dried and sieved with a #200 Standard US sieve (0.074 millimeters) in order to remove any large aggregates. The powder mixture was then pressed to 10 megapascals (MPa) at room temperature to a disk approximately 50 millimeters in diameter by 10 millimeters thick. The disk was then placed in a standard tube furnace with an argon atmosphere and heated until activation of the SHS reaction, which occurred at approximately 920° C. The synthesized disk of metallic matrix composite and uniform reinforcement phase did not crack or suffer catastrophic failure upon cooling to room temperature. X-ray diffraction analysis after synthesis found the titanium aluminide phase TiAl and the aluminum oxide reinforcement phase $Al_2O_3$.

While the above description provides examples of one or more apparatuses, methods and/or compositions, it will be appreciated that the scope of the claims should not be limited by the preferred embodiments set forth in the examples, but should be given the broadest interpretation consistent with the description as a whole.

I claim:

1. A metallic matrix composite, comprising:

a metallic matrix; and an in situ formed reinforcement, wherein the reinforcement comprises discrete particles substantially uniformly dispersed within the metallic matrix, wherein each of the particles comprises a reinforcement constituent disposed about a core formed of an inert nucleator compound, and wherein the nucleator compound comprises Zr.

2. The metallic matrix composite of claim 1, wherein the discrete particles have a mean particle size of less than 3 μm.

3. The metallic matrix composite of claim 1, wherein the nucleator compound is substantially in the form of a particulate having a mean average particle size of no more than about 1 μm.

4. The metallic matrix composite of claim 1, wherein the metallic matrix and the in situ formed reinforcement are each formed in a self-propagating high-temperature synthesis reaction between a first reactant and a second reactant in a reaction mixture with the nucleator compound, the first reactant being a metallic element or a metallic compound, and the second reactant being a metallic compound.

5. The metallic matrix composite of claim 4, wherein the first reactant is a metallic element, and the nucleator compound is a metallic element bonded to a non-metallic element.

6. The metallic matrix composite of claim 5, wherein:

$\Delta_f H$ of a metallic compound consisting of the metallic element of the nucleator compound bonded to the metallic element of the first reactant minus $\Delta_f H$ of the nucleator compound, is larger than $\Delta_f H$ of the metallic matrix minus $\Delta_f H$ of the reinforcement; or $\Delta_f G$ of a metallic compound consisting of the metallic element of the nucleator compound bonded to the metallic element of the first reactant minus $\Delta_f H$ of the nucleator compound, is larger than $\Delta_f G$ of the metallic matrix minus $\Delta_f G$ of the reinforcement.

7. The metallic matrix composite of claim 4, wherein at least one of the first and second reactants is a metallic compound formed of a metallic element bonded to a non-metallic element selected from the group consisting of B, N, O and Si, and the nucleator compound consists substantially of the non-metallic element.

8. The metallic matrix composite of claim 1, wherein the nucleator compound consists of Zr bonded to a non-metallic element.

9. The metallic matrix composite of claim 8, wherein the non-metallic element is selected from B and O.

10. The metallic matrix composite of claim 8, wherein the nucleator compound consists substantially of a compound selected from the group consisting of $ZrB_2$, $ZrO_2$, and $ZrO_2$-3Y.

11. The metallic matrix composite of claim 4, wherein the first reactant is a metallic element selected from Ag, Al, Fe, Mg, Ni, and Ti.

12. The metallic matrix composite of claim 4, wherein the first reactant is a metallic compound comprising a metallic element selected from Ag, Al, Fe, Mg, Ni, and Ti.

13. The metallic matrix composite of claim 4, wherein the metallic compound being the second reactant comprises a metallic element selected from the group consisting of Ag, Al, Fe, Mg, Ni, and Ti.

14. The metallic matrix composite of claim 4, wherein at least one of the first and second reactants is a metallic compound selected from the group consisting of a metal boride, a metal carbide, a metal nitride, a metal oxide, and a metal silicide.

15. The metallic matrix composite of claim 4, wherein the first reactant is Al, the second reactant is $TiO_2$, the metallic matrix consists substantially of TiAl, and the in situ formed reinforcement consists substantially of $Al_2O_3$.

16. The metallic matrix composite of claim 15, wherein the nucleator compound is a compound selected from the group consisting of $ZrO_2$, $ZrO_2$—Y, and $ZrO_2$-3Y.

17. A metallic matrix composite, comprising:

a metallic matrix comprising TiAl; and an in situ formed reinforcement comprising $Al_2O_3$, wherein the reinforcement comprises discrete particles substantially uniformly dispersed within the metallic matrix comprising, and wherein each of the particles comprises a reinforcement constituent disposed about a core formed of an inert nucleator compound.

* * * * *